US008794332B2

(12) United States Patent
Bell

(10) Patent No.: US 8,794,332 B2
(45) Date of Patent: Aug. 5, 2014

(54) ANNULUS VENT SYSTEM FOR SUBSEA WELLHEAD ASSEMBLY

(75) Inventor: Robert Bell, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 535 days.

(21) Appl. No.: 13/149,523

(22) Filed: May 31, 2011

(65) Prior Publication Data

US 2012/0305259 A1 Dec. 6, 2012

(51) Int. Cl.
*E21B 43/01* (2006.01)
*E21B 36/00* (2006.01)

(52) U.S. Cl.
USPC ..... 166/344; 166/368; 166/302; 166/304

(58) Field of Classification Search
USPC ..... 166/344, 368, 302, 369, 57, 75.12, 304; 432/29, 31
See application file for complete search history.

(56) References Cited

U.S. PATENT DOCUMENTS 5,280,766 A * 1/1994 Mohn ..... 166/368
5,884,706 A * 3/1999 Edwards ..... 166/335
5,971,077 A * 10/1999 Lilley ..... 166/368
5,992,527 A * 11/1999 Garnham et al. ..... 166/379
6,076,605 A * 6/2000 Lilley et al. ..... 166/368
6,357,529 B1 * 3/2002 Kent et al. ..... 166/344
6,415,868 B1 * 7/2002 Janoff et al. ..... 166/368
8,157,015 B2 * 4/2012 Voss et al. ..... 166/368
8,371,385 B2 * 2/2013 Lewis ..... 166/368
2003/0010499 A1 * 1/2003 Qvam et al. ..... 166/335

FOREIGN PATENT DOCUMENTS

WO 2007092956 A2 8/2007
WO 2010120184 A1 10/2010

OTHER PUBLICATIONS

GB Search Report dated Aug. 20, 2012 from corresponding Application No. GB1209551.9.

* cited by examiner

*Primary Examiner* — Matthew Buck
(74) *Attorney, Agent, or Firm* — Bracewell & Giuliani LLP

(57) ABSTRACT

A wellhead system for producing hydrocarbons from a subterranean formation that includes concentric tubulars that form an annulus. The annulus is vented by flowing fluid from the annulus through a bleed line having a valve that is selectively opened and closed. Upstream of the bleed line valve, the bleed line is routed adjacent a production flow line. The temperature of the fluid in the production flow line is greater than annulus temperature and warms the bleed line. Hydrate formation in the bleed line is thereby inhibited by the thermal energy it receives from the production flow line.

13 Claims, 2 Drawing Sheets

ANNULUS VENT SYSTEM FOR SUBSEA WELLHEAD ASSEMBLY

FIELD OF THE INVENTION

This invention relates in general to production of oil and gas wells, and in particular to a wellhead system having a flow line for venting an annulus in the wellhead system that is heated by a production flow line also within the wellhead system.

DESCRIPTION OF RELATED ART

Wellheads used in the production of hydrocarbons extracted from subterranean formations typically comprise a wellhead assembly attached at the upper end of a wellbore formed into a hydrocarbon producing formation. Wellhead assemblies usually provide support hangers for suspending production tubing and casing into the wellbore. The casing lines the wellbore, thereby isolating the wellbore from the surrounding formation. The tubing typically lies concentric within the casing and provides a conduit therein for producing the hydrocarbons entrained within the formation.

Wellhead assemblies also typically include a wellhead housing adjacent where the casing and tubing enter the wellbore, and a production tree atop the wellhead housing. The production tree is commonly used to control and distribute the fluids produced from the wellbore and selectively provide fluid communication or access to the tubing, casing, and/or annuluses between the tubing and casing. Valves assemblies are typically provided within wellhead production trees for controlling fluid flow across a wellhead, such as production flow from the borehole or circulating fluid flow in and out of a wellhead.

In FIG. 1, one example of a prior art wellhead assembly 10 is shown in a side sectional view. The wellhead assembly 10 is mounted on a wellbore 12 that intersects a subterranean formation 14. As is typical, the wellhead assembly 10 includes a main bore 16 that registers with the wellbore 12 and extends vertically upwards through the wellhead assembly 10. Swab valves 18 are generally set within the main bore 16 for isolating the main bore 16 and wellbore 12 from ambient conditions above the wellhead assembly 10. Production from the wellbore 12 is generally accomplished via a production line 20 shown intersecting the main bore 16 and extending laterally through a production tree 21. A production wing valve 22 is shown within the production line 20 for selectively regulating flow through the production flow line 20. Often, wellhead assemblies 10 also include an annulus line 24 mounted on the production tree 21 and which usually includes an annulus wing valve 25 for controlling flow therein.

Generally, production tubing 26 is the inner most tubular within a wellhead assembly 10, thus the inner surface of the production tubing 26 defines the production bore 16. Circumscribing the production tubing 28 is casing 28 that generally extends down from the tree 21 and into the wellbore 28 to form a wellhead housing. An annulus 30 is defined between the tubing 26 and casing 28 which typically is in communication with the annulus line 24. Often, for access or for venting of the annulus 30, an annulus bleed line 32, which is schematically illustrated in FIG. 1, has one end connected to the annulus 30 and often is routed to above sea surface in the case of sub sea wells. A bleed valve 34 is shown included within the bleed line 32 and is generally implemented for regulating flow through the bleed line 32.

Fluids produced from within the wellbore 12 can include components that form hydrates when subjected to certain temperatures and pressures. When formed, hydrates are ice like solids made up of gases enclosed within a cage of hydrogen bonded water molecules. Because hydrate formation can occur when cooling a fluid having hydrate components, flow circuits that experience a sudden pressure drop, such as through a throttling valve, may induce hydrate formation. The ice like nature of hydrates typically impedes fluid flow through lines and valves of a flow circuit. Chemical injections can be useful for avoiding hydrate formation, but performing and maintaining the injections introduces added complexity to production of hydrocarbons.

SUMMARY OF THE INVENTION

Disclosed herein is an example of a wellhead assembly equipped with an annulus bleed line designed to prevent hydrate formation. In an example embodiment the wellhead assembly includes a wellhead housing mounted on a wellbore with a production tree connected on top of the wellhead housing. A production flow path is formed through the wellhead housing and production tree, where the production flow path is in fluid communication with the wellbore. Concentric tubulars are included with the wellhead assembly, both of which are registered with the wellbore. The concentric tubulars define an annulus therebetween. The annulus bleed line has an end in fluid communication with the annulus and has a portion routed so that it is in thermal communication with the production flow path. Thus when production fluid from the wellbore flows through the production flow path, and annulus fluid is in the bleed line, thermal energy from the production fluid transferred to bleed line heats the annulus fluid in the bleed line. Heating the annulus fluid that is in the bleed line prevents hydrate formation in the bleed line, even when the annulus fluid is throttled across a valve. In an example embodiment, the wellhead assembly further includes a cross over line for selectively providing fluid communication between the annulus and the production flow path; in this embodiment the bleed line has an end connected to the cross over line. In an example embodiment, the portion of the production tree having the production flow path defines a production wing block, and the bleed line is provided in the production wing block. In an example embodiment, a portion of the bleed line is adjacent a portion of the production flow path. In an example embodiment, a portion of the bleed line contacts a portion of the production flow path. In an example embodiment, a portion of the bleed line circumscribes a portion of the production flow path. In an example embodiment, the portion of the bleed line circumscribing the portion of the production flow path can be one or both of a helical line or a jacket. In an example embodiment the wellbore is subsea.

Also disclosed herein is a method of preventing hydrate formation in fluid produced from a wellbore. In an example embodiment, the method includes providing a wellhead assembly: where the wellhead assembly is made up of a wellhead housing mounted on the wellbore, a production tree connected on top of the wellhead housing, a production flow path formed through the wellhead housing and production tree and in fluid communication with the wellbore. An annulus is formed between concentric tubulars that are registered with the wellbore. Further included with the wellhead assembly is a bleed line having an end in fluid communication with the annulus and having a portion routed in thermal communication with the production flow path. The method further includes flowing production fluid from the wellbore through the production flow path, flowing annulus fluid from the annulus through the bleed line, and heating the annulus fluid by transferring heat from the production fluid to the annulus fluid so that the annulus fluid is at a temperature above that which hydrates are formed. In an example embodiment, after heating the annulus fluid, the annulus fluid is transferred to above sea surface while retaining sufficient thermal energy to remain above a hydrate forming temperature.

DETAILED DESCRIPTION OF THE INVENTION

Figure 1:
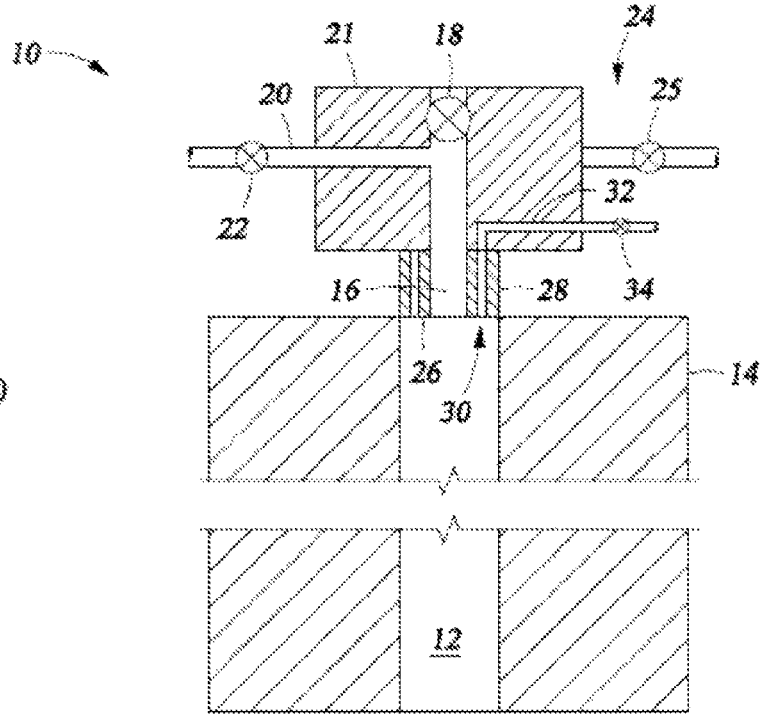
Fig. 1 (PRIOR ART)
FIG. 1 is a side partial sectional view of a prior art wellhead assembly.

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

Figure 2:
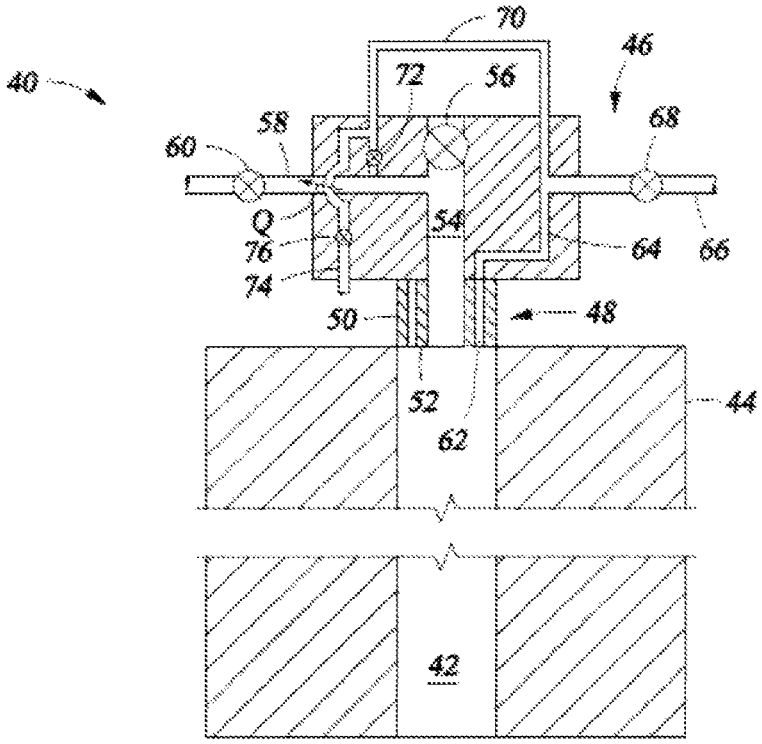
FIG. 2 is a side sectional view of an example embodiment of a wellhead assembly in accordance with the present invention.

Referring now to FIG. 2, one example of a wellbore assembly 40 is shown in a side sectional view; where the wellbore assembly 40 is shown mounted above a wellbore 42 that is formed within a subterranean formation 44. In the example embodiment of FIG. 2, the wellhead assembly 40 includes a production tree 46 that mounts over a wellhead housing 48. In the example of FIG. 2, the wellhead housing 48 includes an outer tubular 50 shown depending into the wellbore 42. The outer tubular 50 can be a string of casing, such as conductor pipe or production casing. Also depending into the wellbore 42 is production tubing 52 illustrated as concentrically disposed within the casing 50 and registering with the wellbore 42. A main bore 54 is shown above an upper end of the production tubing 52 that extends upward within the production tree 46 and includes a swab valve 56 in its upper portion. A production flow line 58 is shown formed laterally through the production tree 46 having an end in communication with the main bore 54. The combination of the main bore 54 and production line 58 defines a production flow path for flowing production fluids from the wellbore 42 to a production facility (not shown). Set within the production line 58 is a wing valve 60 used for regulating flow through the production line 58.

An annulus 62 is defined between the concentric production tubing 52 and casing 50. An annulus passage 64 is illustrated in FIG. 2 that extends within the production tree 46 and into communication with an annulus flow line 66. The annulus flow line 66 may be used for providing access to the annulus 62 as well as introducing fluids from the surface into the annulus 62, or for venting of fluids within the annulus 62 to surface or another designated location. An annulus wing valve 68 provided within the annulus flow line 66 can be used for selectively allowing flow through the annulus flow line 66.

Still referring to FIG. 2, a crossover line 70 extends from the annulus flow line 66, at a location upstream of the wing valve 68 and connects to the production flow line 58 upstream of the wing valve 60. A crossover valve 72 is shown set within the crossover line 70 for controlling flow through the crossover line 70. A bleed line 74 connects to the crossover line 70 in the portion between the crossover valve 72 and where the crossover line 70 contacts the annulus flow line 66. A selectively opened and closed bleed valve 76 is provided within the bleed line 74 for venting fluid within the annulus 62 to a location away from the wellhead assembly 40. Further illustrated in the embodiment of FIG. 2 is how the bleed line 74 is disposed in thermal communication with the production line 58. As the production fluid within the production flow line 58 is typically heated above that of the fluid in the annulus 62, thermal energy (represented as Q) will be transferred from the production flow line 58 and into the bleed line 74. As such, the fluid within the bleed line 74 may be maintained at a temperature sufficient such that hydrates will be prevented from forming within the fluid. Moreover, embodiments exist wherein the amount of heat Q transferred is sufficient to prevent hydrate formation even downstream of the valve 76 where the annulus fluid is let down to a much lower pressure. As is known, the throttling effect across a valve, especially in instances of relatively large pressure drop, can in turn produce a temperature reduction in which hydrate formation production is enhanced. Thus by heating the fluid in the bleed line 74, especially prior to any pressure letdown such as provided in the bleed valve 76, hydration formation may be prevented thereby enhancing fluid flow of the annulus fluid.

Figure 3:
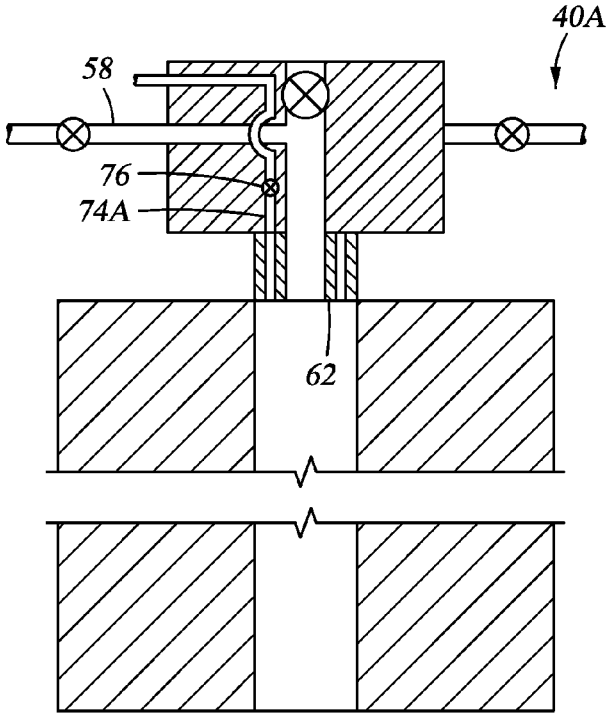
FIG. 3 is a side sectional view of an alternate embodiment of a wellhead assembly in accordance with the present invention.

FIG. 3 illustrates in a side sectional view an example embodiment of a wellhead assembly 40A that is configured for avoiding hydrate formation in the annulus fluid. More specifically, in the example of FIG. 3, fluid from the annulus 62 is routed through a bleed line 74A that connects directly to the annulus 62 and is piped similar to the embodiment of FIG. 2 so that thermal communication is maintained with the production flow line 58. As such, the need for the crossover line or spool of FIG. 2 is unnecessary for the venting of fluid within the annulus 62 to a surface location.

Figure 4:
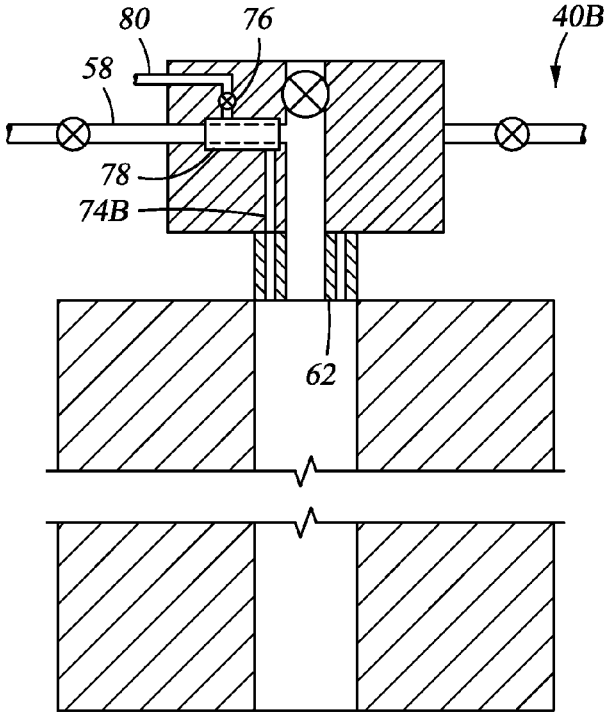
FIG. 4 is a side sectional view of an alternate embodiment of a wellhead assembly in accordance with the present invention.

FIG. 4 illustrates yet another embodiment of a wellhead assembly 40B that allows fluid from the annulus 62 to be conveyed above surface without formation of hydrates. More specifically, the embodiment of FIG. 4 includes a bleed line 74B that connects to the annulus 62 on one end and to a jacket 78 on an opposite end. The jacket 78 is shown circumscribing the production flow line 58 so that the fluid within the bleed line 74B flows over and contacts with the outer surface of the production flow line 58 thereby receiving thermal energy from production fluid in the production flow line 58. Dashed lines illustrate the portion of the production flow line 58 surrounded by the jacket 78. On a discharge side of the jacket 78, a bleed line 80 is provided for transferring the annulus fluid to a site away from the wellhead assembly 40B. The bleed valve 76 is shown integrally provided within the bleed line 80.

While the invention has been shown or described in only some of its forms, it should be apparent to those skilled in the art that it is not so limited, but is susceptible to various changes without departing from the scope of the invention.

What is claimed is:

1. A wellhead assembly comprising:

a wellhead housing mounted on a wellbore;

a production tree connected on top of the wellhead housing;

a production flow path formed through the wellhead housing and production tree and in fluid communication with the wellbore;

an annulus defined between concentric tubulars that are registered with the wellbore; and a bleed line having an end in fluid communication with the annulus and having a portion routed in thermal communication with the production flow path, so that when production fluid from the wellbore flows through the production flow path and annulus fluid is in the bleed line, thermal energy from the production fluid transferred to the bleed line heats the annulus fluid in the bleed line.

2. The wellhead assembly of claim 1, further comprising a cross over line for selectively providing fluid communication between the annulus and the production flow path, wherein the bleed line has an end connected to the cross over line.

3. The wellhead assembly of claim 1, wherein the portion of the production tree having the production flow path defines a production wing block, and wherein the bleed line is provided in the production wing block.

4. The wellhead assembly of claim 1, wherein the production flow path defines a production flow line, and wherein a portion of the bleed line is adjacent a portion of the production flow line.

5. The wellhead assembly of claim 1, wherein a portion of the bleed line contacts a portion of the production flow path.

6. The wellhead assembly of claim 1, wherein a portion of the bleed line circumscribes a portion of the production flow path.

7. The wellhead assembly of claim 6, wherein the portion of the bleed line circumscribing the portion of the production flow path comprises a member selected from the group consisting of a helical line and a jacket.

8. The wellhead assembly of claim 1, wherein the wellbore is subsea.

9. The wellhead assembly of claim 1, wherein a portion of the production flow path extends through a main bore that extends axially through the wellhead housing and production tree, and another portion of the production flow path extends through a production line that has an end in communication with the main bore and projects through the production tree, and wherein a portion of the bleed line distal from the annulus runs adjacent to the production line so that the thermal energy conducts from the production line, through the production tree, and to the portion of the bleed line in the production tree.

10. A method of preventing hydrate formation in fluid produced from a wellbore, the method comprising:

a. providing a wellhead assembly comprising a wellhead housing mounted on the wellbore, a production tree connected on top of the wellhead housing, a production flow path formed through the wellhead housing and production tree and in fluid communication with the wellbore, an annulus defined between concentric tubulars that are registered with the wellbore, and a bleed line having an end in fluid communication with the annulus and having a portion routed in thermal communication with the production flow path;

b. flowing production fluid from the wellbore through the production flow path;

c. flowing annulus fluid from the annulus through the bleed line; and d. heating the annulus fluid by transferring heat from the production fluid to the annulus fluid so that the annulus fluid is at a temperature above that which hydrates are formed.

11. The method of claim 10, after heating the annulus fluid, the annulus fluid is transferred to above sea surface while retaining sufficient thermal energy to remain above a hydrate forming temperature.

12. The method of claim 10, further comprising flowing the annulus fluid through a throttling valve in the bleed line thereby reducing pressure of the annulus fluid, wherein the annulus fluid temperature drops to a reduced temperature that is above a hydrate formation temperature.

13. The method of claim 10, wherein the heat transferred from the production fluid to the annulus fluid is conducted through the production tree.

* * * * *